US011827475B2

(12) United States Patent
Hayashi et al.

(10) Patent No.: US 11,827,475 B2
(45) Date of Patent: Nov. 28, 2023

(54) IMAGE FORMING APPARATUS

(71) Applicant: CANON KABUSHIKI KAISHA, Tokyo (JP)

(72) Inventors: Hideki Hayashi, Yoshikawa (JP); Atsushi Yoshida, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 199 days.

(21) Appl. No.: 16/932,999

(22) Filed: Jul. 20, 2020

(65) Prior Publication Data

US 2021/0032064 A1 Feb. 4, 2021

(30) Foreign Application Priority Data

Aug. 1, 2019 (JP) ..... 2019-142194

(51) Int. Cl.

*B65H 29/12* (2006.01)
*B65H 29/52* (2006.01)
*B65H 85/00* (2006.01)

(52) U.S. Cl.

CPC ..... *B65H 29/125* (2013.01); *B65H 29/52* (2013.01); *B65H 85/00* (2013.01); *B65H 2404/612* (2013.01); *B65H 2701/11312* (2013.01)

(58) Field of Classification Search

CPC ..... B65H 29/125; B65H 29/52; B65H 85/00
See application file for complete search history.

(56) References Cited

U.S. PATENT DOCUMENTS 4,878,656 A 11/1989 Honjo et al.
5,018,716 A 5/1991 Yoshida et al.
5,105,225 A 4/1992 Honjo et al.
5,351,112 A 9/1994 Naito et al.
5,442,431 A 8/1995 Fujimoto et al.
5,579,083 A 11/1996 Naito et al.
5,671,917 A 9/1997 Choho et al.
5,819,151 A 10/1998 Naito et al.
6,021,305 A 2/2000 Sato et al.
6,098,977 A 8/2000 Sato et al.
6,450,711 B1 9/2002 Conrow
(Continued)

FOREIGN PATENT DOCUMENTS

JP 2002-220150 A 8/2002
JP 2015-025911 A 2/2015
(Continued)

OTHER PUBLICATIONS

May 2, 2023 Japanese Official Action in Japanese Patent Appln. No. 2019-142194.

*Primary Examiner* — Patrick Cicchino
(74) *Attorney, Agent, or Firm* — Venable LLP

(57) ABSTRACT

An image forming apparatus includes an image forming portion, a sheet reversing roller portion, a first sheet feeding passage, a second sheet feeding passage, a sheet a guiding member forming a retraction feeding passage for guiding upward a leading end of the sheet fed from the reversing roller portion rotating in the first direction and then for guiding the sheet, guided upward, in a direction crossing a vertical direction, the guiding member having an inner surface curved to guide one side of the sheet, and a preventing member for preventing a droop of the leading end of the sheet by contact with the sheet guided in the direction crossing the vertical direction by the sheet guiding member.

18 Claims, 12 Drawing Sheets

(56) References Cited

U.S. PATENT DOCUMENTS

| | | | | |
|---|---|---|---|---|
| 6,550,762 | B2 * | 4/2003 | Stoll | B65H 15/004 271/186 |
| 10,152,012 | B2 | 12/2018 | Yoshida et al. | |
| 10,280,020 | B2 | 5/2019 | Yoshida | |
| 10,384,902 | B2 | 8/2019 | Shiina | |
| 10,577,205 | B2 | 3/2020 | Kokubo | |
| 10,954,088 | B2 * | 3/2021 | Sakurai | B65H 85/00 |
| 2008/0193181 | A1 * | 8/2008 | Jeong | H04N 1/00578 399/401 |
| 2018/0305152 | A1 * | 10/2018 | Sakurai | B65H 5/062 |
| 2018/0305153 | A1 | 10/2018 | Kokubo | |
| 2019/0033769 | A1 | 1/2019 | Shiina | |
| 2020/0073327 | A1 | 3/2020 | Hayashi | |
| 2022/0002102 | A1 * | 1/2022 | Koyanagi | B65H 85/00 |

FOREIGN PATENT DOCUMENTS

| | | | |
|---|---|---|---|
| JP | 2018-184228 | A | 11/2018 |
| JP | 2018-184229 | A | 11/2018 |
| JP | 2019-026405 | A | 2/2019 |

* cited by examiner

IMAGE FORMING APPARATUS

FIELD OF THE INVENTION AND RELATED ART

The present invention relates to an image forming apparatus for forming an image on a sheet.

The image forming apparatus such as a printer, a copying machine or a multi-function machine is provided with a reverse feeding mechanism for charging a front side and a back-side of a sheet as a recording material depending on a purpose such as double-side printing or a face-down discharge. The reverse feeding mechanism executes an operation in which in order to change the front side and the back-side of the sheet, a leading end and a trailing end of the sheet fed are changed by reversing the sheet. This operation is called switch-back feeding of the sheet in general, and the switch-back feeding is carried out by a reversing roller pair for reversing and feeding the sheet.

In the case where the double-side printing is executed, the sheet subjected to the switch-back feeding by the reversing roller pair is fed to a re-feeding passage for the double-side printing. Then, the sheet is fed again to the image forming portion in a state in which a first surface of the sheet on which an image has already been formed and a second surface of the sheet which is opposite from the first surface and on which an image is formed.

In such a reverse feeding mechanism, there is a need to retract the sheet when the sheet is reversed. As a retracting space in which the sheet is retracted, a space corresponding to a length of the sheet is needed, and particularly, in order to meet an elongated sheet (long sheet), there is a liability that upsizing of the image forming apparatus is invited. For that reason, Japanese Laid-Open Patent Application (JP-A) 2015-25911 discloses a constitution in which an option unit is provided with a retraction feeding passage for the sheet.

However, as in JP-A 2015-25911, in the constitution in which the retraction feeding passage is curved at a plurality of positions, a resistance exerted on the elongated sheet increases particularly at the curved portions. As a result, there is a liability that problems such as a loss of synchronism of a feeding motor for feeding the sheet, a slip between the sheet and a feeding roller and oblique movement of the sheet occur. Therefore, in JP-A 2018-184229, a constitution in which a guiding member forming the retraction feeding passage is provided only on one side of the retraction feeding passage and thus a feeding resistance is alleviated is disclosed. However, in the constitution in which the guiding member is disposed only on one side of the retraction feeding passage, particularly when the sheet is a sheet, which has a length exceeding a predetermined length, such as an elongated sheet, a leading end of the sheet droops due to a self-weight of the sheet. Thus, when switch-back feeding is carried out while the leading end of the sheet droops, there is a liability that the sheet is damaged in such a manner that for example, a trace of folding occurs.

SUMMARY OF THE INVENTION

According to an aspect of the present invention, there is provided an image forming apparatus comprising: an image forming portion configured to form an image on a sheet to be fed; a reversing roller portion configured to reverse the sheet, on which first surface the image is formed by the image forming portion, by feeding the sheet by rotation thereof in a first direction and then by feeding the sheet by rotation thereof in a second direction opposite to the first direction; a first feeding passage configured to guide the sheet, on which first surface the image is formed by the image forming portion, toward the reversing roller portion; a second feeding passage configured to guide the sheet, reversed by the reversing roller portion, toward the image forming portion to form an image on a second surface of the sheet opposite from the first surface; a guiding member forming a retraction feeding passage for guiding upward a leading end of the sheet fed from the reversing roller portion rotating in the first direction and then for guiding the sheet, guided upward, in a direction crossing a vertical direction, the guiding member having an inner surface curved to guide one side of the sheet; and a preventing member configured to prevent a droop of the leading end of the sheet by contact with the sheet guided in the direction crossing the vertical direction by the guiding member.

By this, it becomes possible to provide an image forming apparatus capable of not only retracting an elongated sheet in a curved state but also suppressing damage on the elongated sheet without increasing a feeding resistance of the elongated sheet.

Further features of the present invention will become apparent from the following description of exemplary embodiments with reference to the attached drawings.

Figure 7:
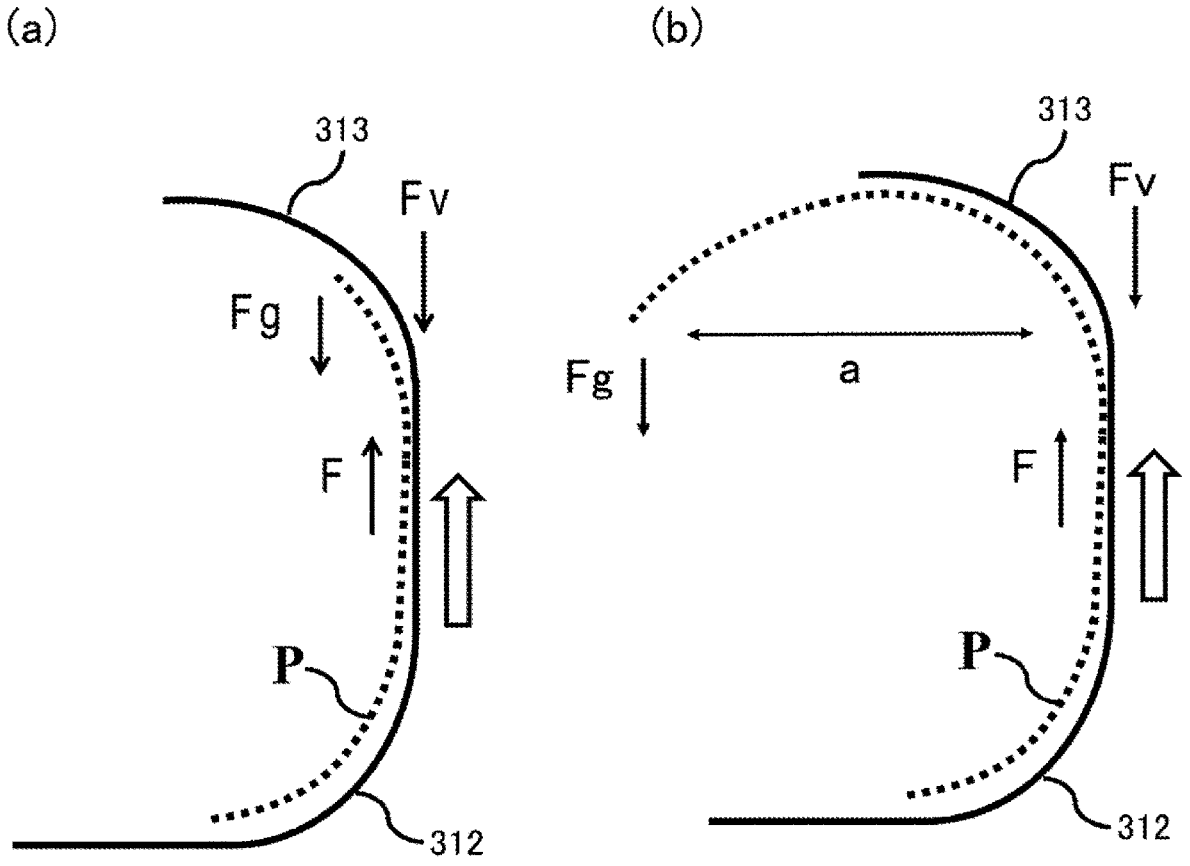

Part (a) of FIG. 7 is a schematic view for illustrating forces acting on the sheet in the reversing roller portion, and part (b) of FIG. 7 is a schematic view for illustrating forces acting on the sheet in the reversing roller portion during a droop of the sheet.

Figure 8:
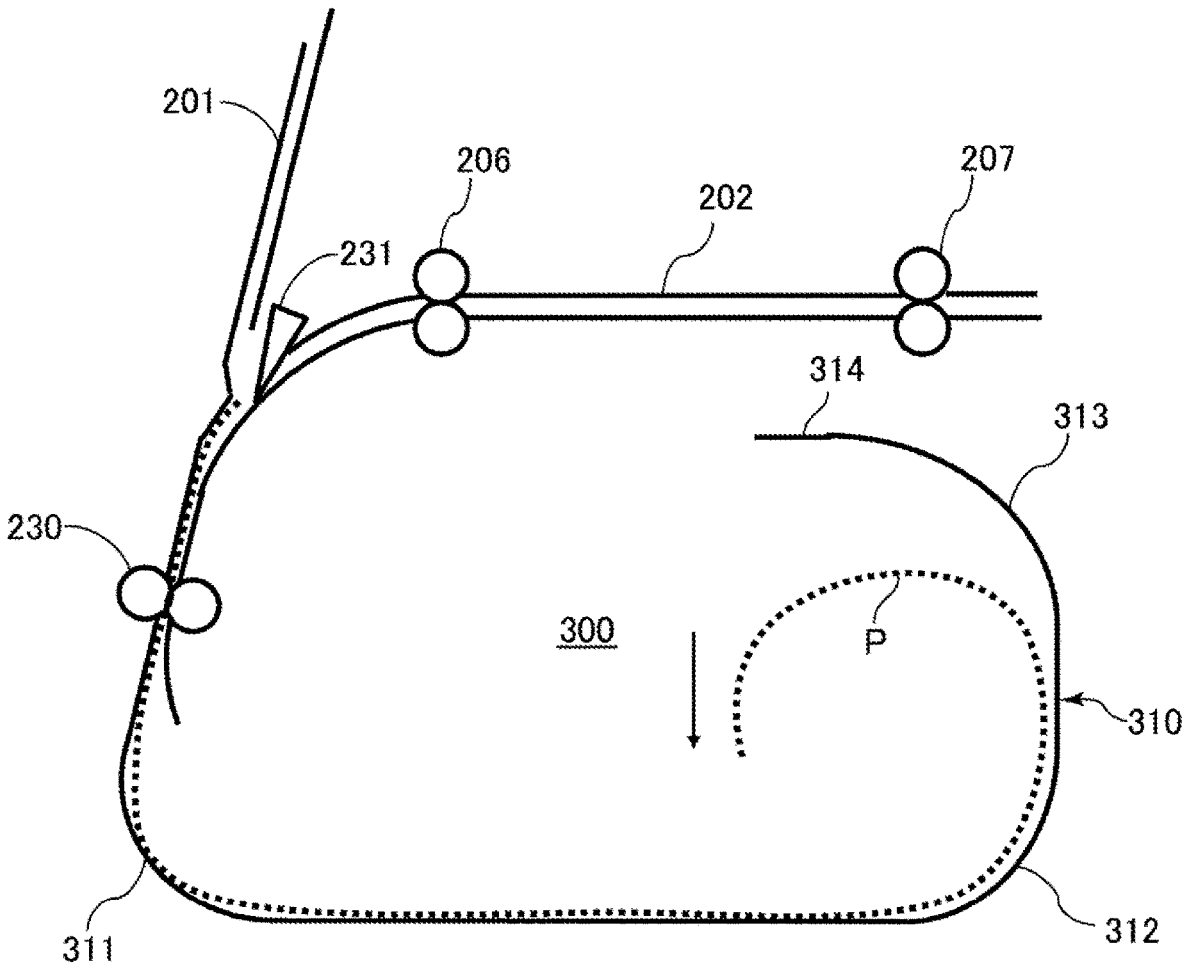

FIG. 8 is a schematic view showing a rounded state of the sheet due to the droop of the sheet.

Figure 9:
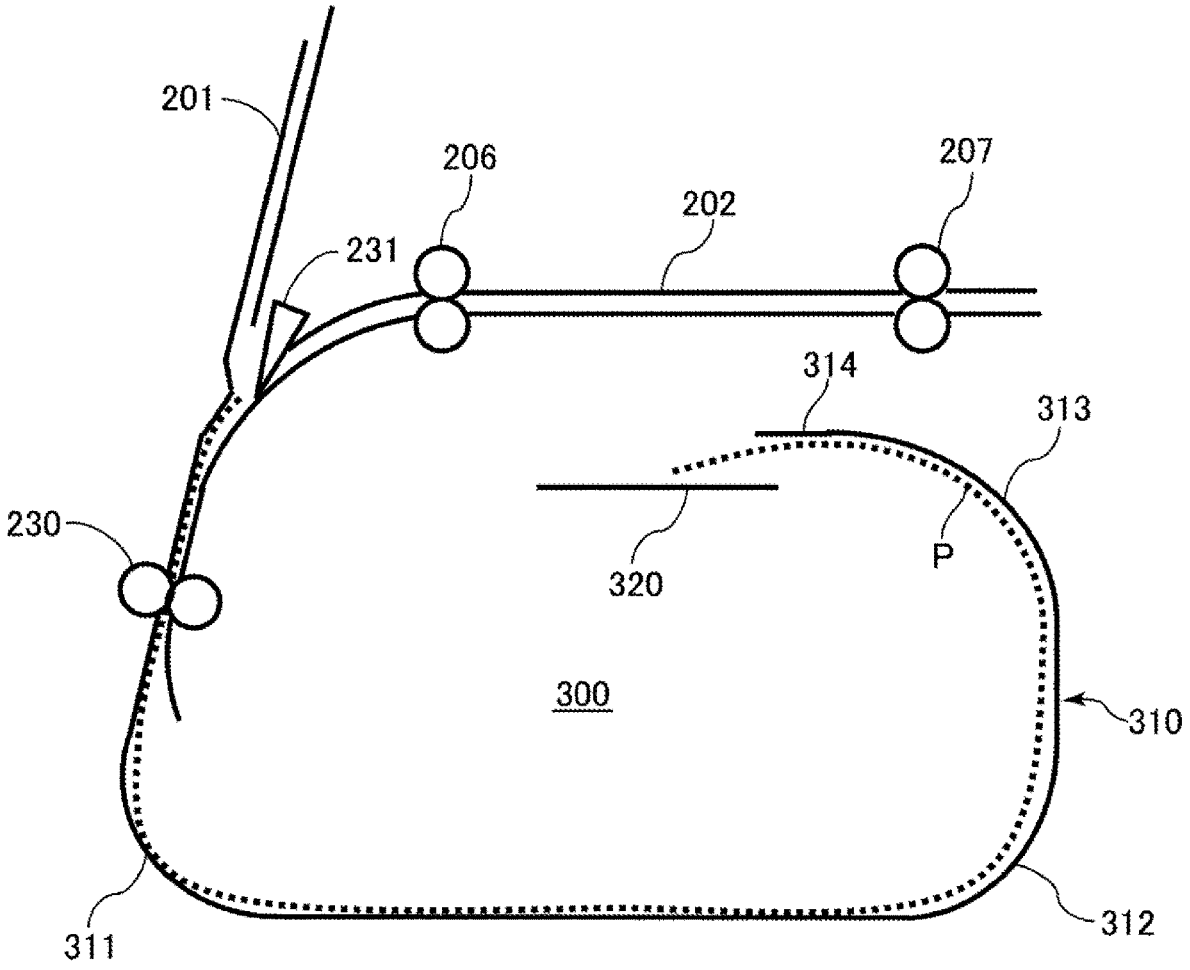

FIG. 9 is a schematic view showing a state in which the droop of the sheet is prevented.

Figure 10:
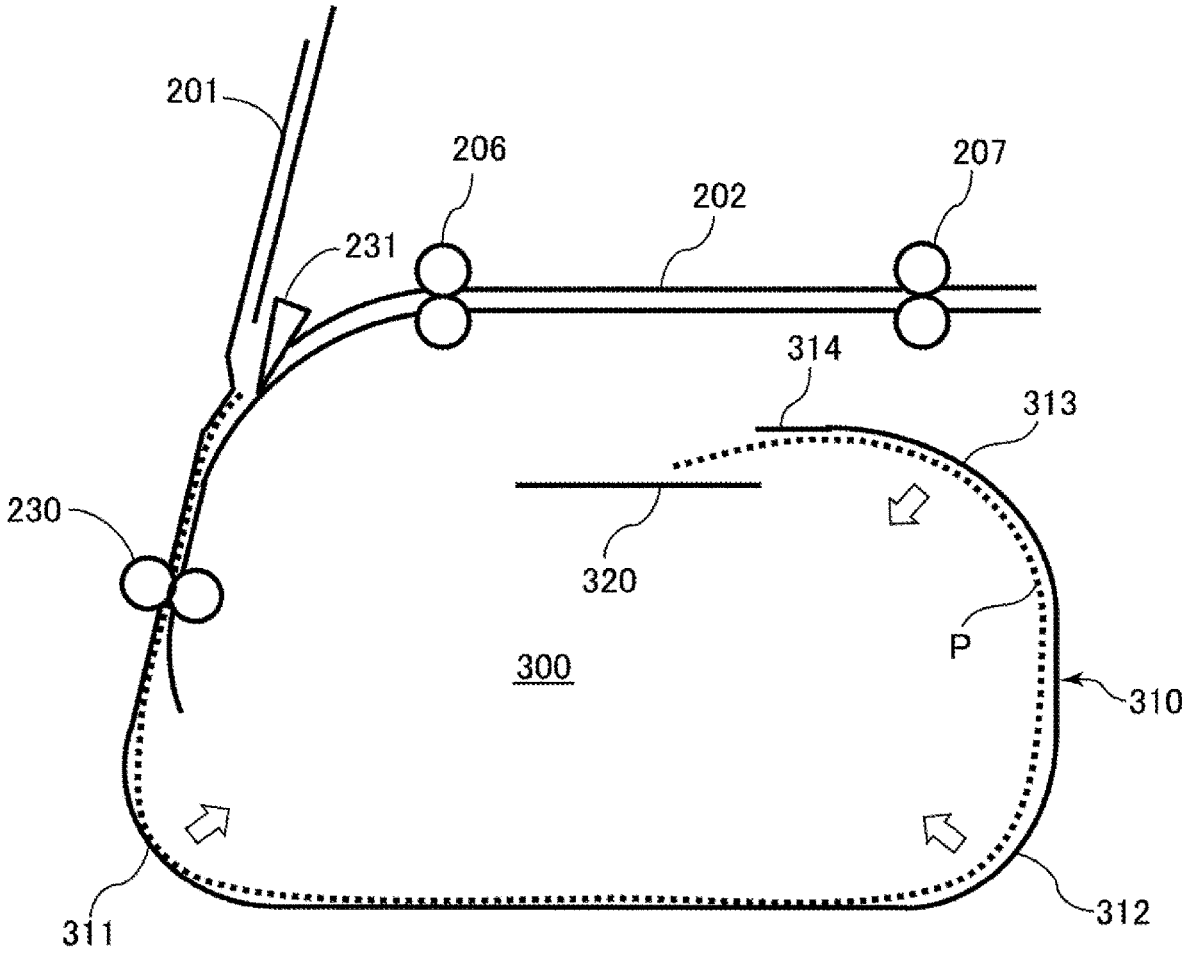

FIG. 10 is a schematic view showing a state in which the droop of the sheet is prevented by a droop preventing guide in the first embodiment 1.

Figure 11:
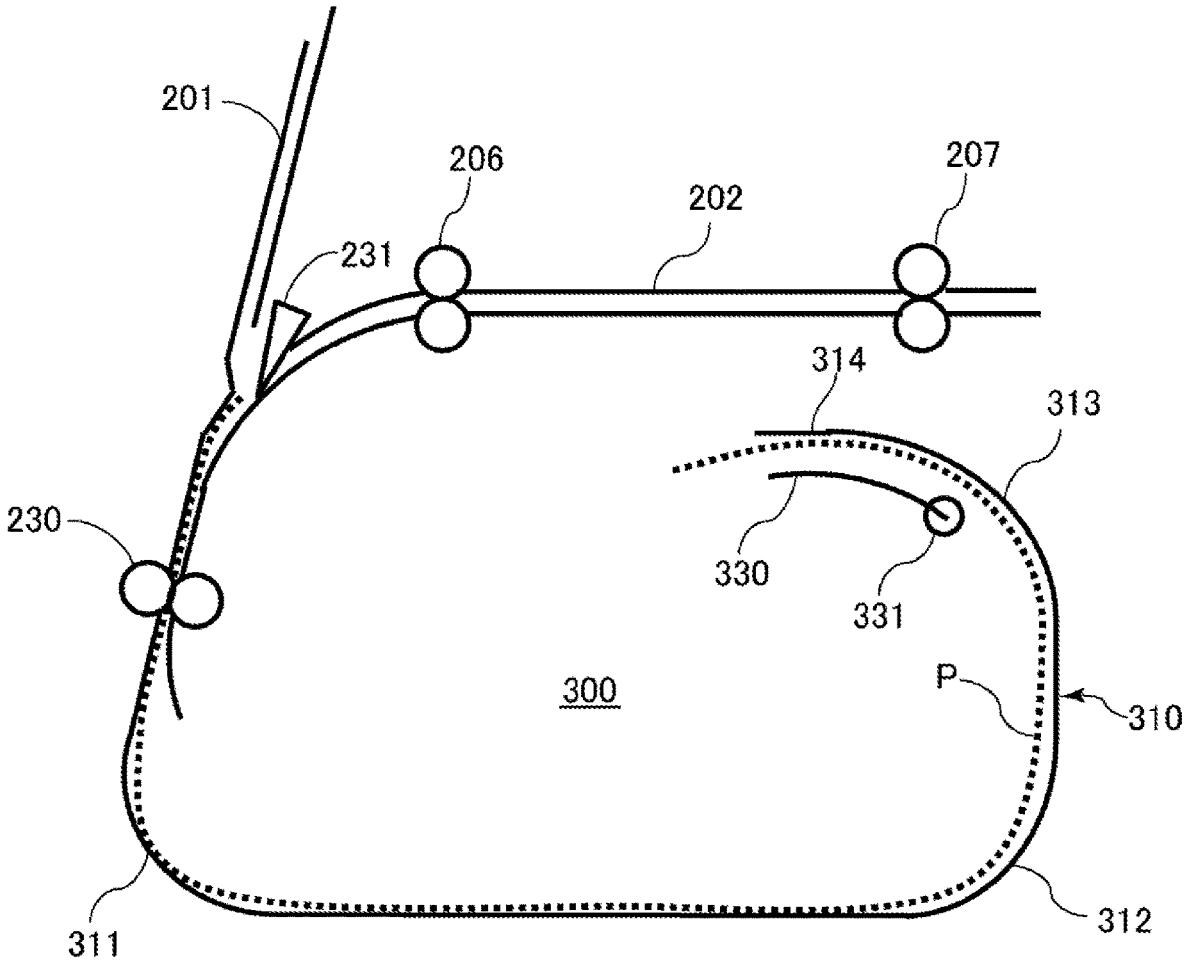

FIG. 11 is a schematic view showing a structure of a reversing roller portion in a second embodiment.

Figure 12:
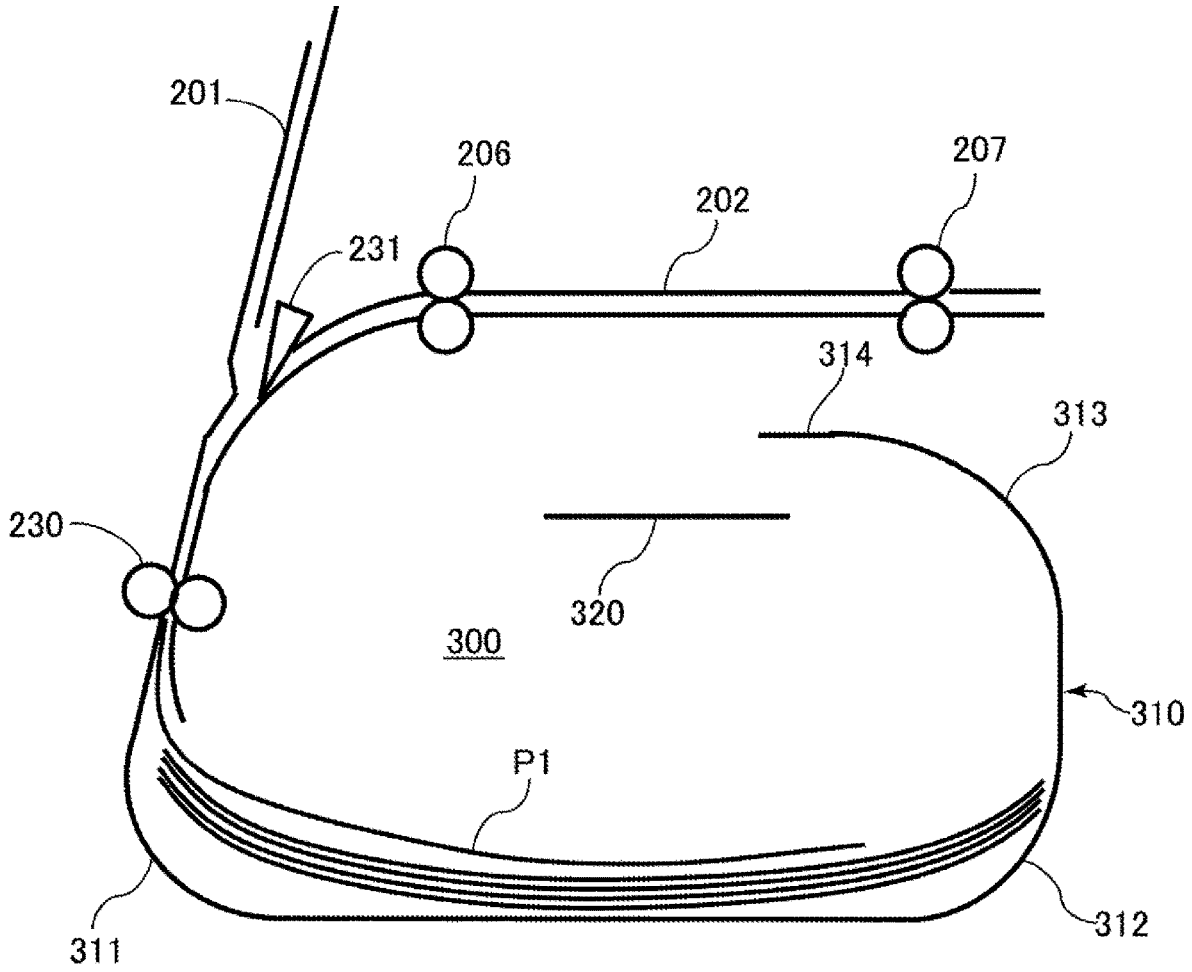

FIG. 12 is a schematic view showing a state in which when sheets are jammed, the sheets fed to the reversing roller portion are stacked.

DESCRIPTION OF EMBODIMENTS

In the following, embodiments for carrying out the present invention will be described while making reference to the drawings. Incidentally, embodiments described below are illustrated as examples, and the present invention is not limited to the following embodiments.

(Image Forming Apparatus)

Figure 1:
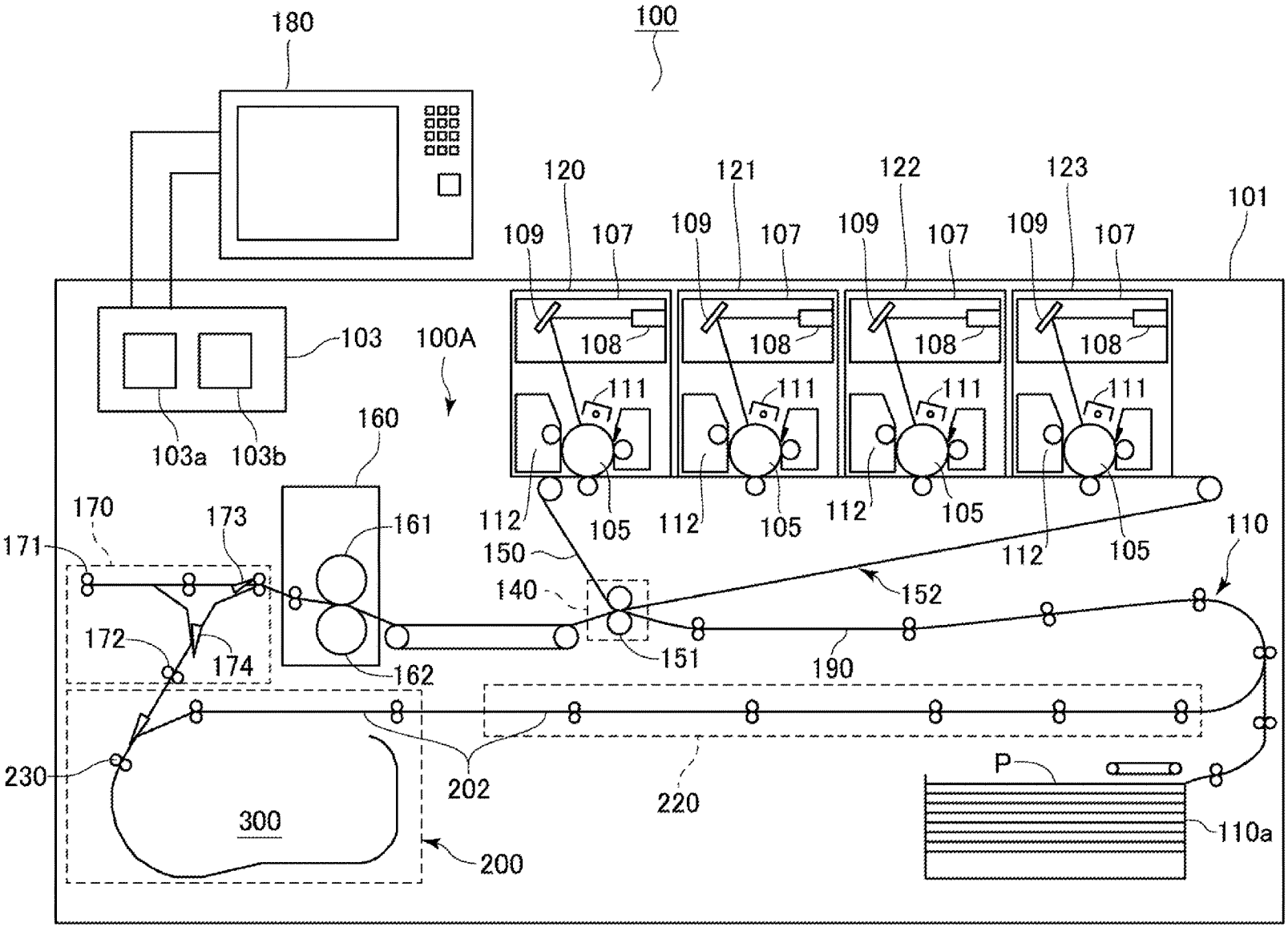
FIG. 1 is a schematic view of an image forming apparatus according to an embodiment of the present invention.

First, a structure of an image forming apparatus according to an embodiment of the present invention will be described. FIG. 1 is a sectional view showing a structure of a laser beam printer 100 which is the image forming apparatus in this embodiment. The printer 100 includes a casing 101, and in the casing 101, mechanisms constituting an engine portion, an engine controller 103*a* and a control board accommodating portion 103 for accommodating a printer controller 103*b* are incorporated. The engine controller 103*a* controls an operation of the respective mechanisms constituting the engine portion. The printer controller 103*b* develops print data received from an external computer and carries out integrated control of the engine controller 103*a*, and thus executes a print job.

In this embodiment, the mechanisms constituting the engine portion refer to optical developing process mechanisms 120, 121, 122 and 123, an intermediary transfer mechanism 152, a secondary transfer portion 140, a fixing process mechanism 160, a feeding and conveying mechanism 110, a discharging mechanism 200 and a double-side feeding mechanism 220. Of these, the optical developing process mechanisms 120, 121, 122 and 123, the intermediary transfer mechanism 152, the secondary transfer portion 140 and the fixing process mechanism 160 constitute an electrophotographic mechanism 100A of a tandem type and an intermediary transfer type in which an image is formed on a sheet.

The optical developing process mechanisms 120, 121, 122 and 123 are stations each for forming a visible image (toner image of a single color by performing steps of charging, exposure and development in an electrophotographic process. The intermediary transfer mechanism 152 is a mechanism for forming a full-color toner image by primary-transferring the visible images formed by the optical developing process mechanisms 120, 121, 122 and 123 and by causing an intermediary transfer member 150 to carry the visible images. The secondary transfer portion 140 is a mechanism for secondary-transferring the toner images from the intermediary transfer member 150 onto a sheet P as a recording material. The fixing process mechanism 160 is a mechanism for fixing an image on the sheet P by subjecting the toner images, transferred on the sheet P, to a fixing process.

The feeding and conveying mechanism 110 is a mechanism for feeding and conveying the sheet p toward the secondary transfer portion 140. The discharging mechanism 170 is a mechanism for discharging the sheet P on which the image is formed by passing of the image through the secondary transfer portion 140 and the fixing process mechanism 160 and for dividing a feeding direction into different directions. The reversing mechanism 200 includes a reverse retracting portion 300 as a retracting portion where the sheet P is temporarily retracted when the sheet P is switched back, and is a mechanism for performing reverse feeding of the sheet P in the case of double-side printing. The double-side feeding mechanism 220 as a re-feeding portion is a mechanism for feeding the sheet P, in a state in which the sheet P is reversed by the reversing mechanism 200, toward the secondary transfer portion 140 again.

A basis operation of the image forming apparatus will be described. A laser scanner portion 107 of each of the optical developing process mechanisms 120, 121, 122 and 123 includes a laser driver for ON/OFF-driving laser light emitted from a semiconductor laser 108 depending on image data supplied from the printer controller 103*b*. The laser light emitted from the semiconductor laser 108 is used for scanning a photosensitive drum surface in a main scan direction by a rotatable polygonal mirror. The laser light changed in direction to the main scan direction is guided to a photosensitive drum 105 through a reflection polygonal mirror 109, so that the surface of the photosensitive drum 105 is exposed to the laser light in the main scan direction. On the other hand, an electrostatic latent image charged by a primary charger 111 and formed on the surface of the photosensitive drum 105 by the scanning exposure to the laser light as described above is visualized (developed) into a toner image by toner supplied by an associated developing device 112.

Thereafter, the toner image carried on the photosensitive drum 105 is primary-transferred, by applying a voltage of a polarity opposite to a charge polarity of the toner image, onto the intermediary transfer member 150 provided in the intermediary transfer mechanism 152. During color image formation, single-color toner images of yellow, magenta, cyan and black formed in the respective optical developing process mechanisms 120 to 123 are successively transferred onto the intermediary transfer member 150, so that a full-color visible image is formed on the surface of the intermediary transfer member 150.

The feeding and conveying mechanism 110 feeds the sheet P in parallel to the above-described image forming operation while separating the sheet P one by one from a sheet bundle accommodated in an accommodating portion 110*a* and conveys the sheet P to the secondary transfer portion 140. A path from the feeding and conveying mechanism 110 to the discharging mechanism 170 through the secondary transfer portion 140 and the fixing process mechanism 160 is a main feeding path 190 along which the image is formed on the sheet P.

Then, the visible images carried on the surface of the intermediary transfer member 150 are transferred (secondary-transferred) onto the sheet P, at the secondary transfer portion 140 constituted by a secondary transfer roller pair 151, fed by the feeding and conveying mechanism 110. The secondary transfer roller pair 151 causes the sheet P to press-contact the intermediary transfer member 150 and simultaneously carries out secondary transfer under application of a bias of a polarity opposite to the toner charge polarity.

The sheet P passed through the secondary transfer portion 140 is fed to the fixing process mechanism 160. The fixing process mechanism 160 includes a heating roller 161 and a pressing roller 162 which nip and feed the sheet P and includes a heat source (for example, a halogen lamp) for heating the toner image on the sheet P through the heating roller 161. The sheet P passes through a fixing nip constituted by the heating roller 161 and the pressing roller 162, so that the toner (image) transferred on the sheet P is heated and melted and thereafter is solidified, and thus an image fixed on the sheet P is obtained.

The sheet P passed through the fixing process mechanism 160 is fed to the discharging mechanism 170. In the discharging mechanism 170, a feeding path (feeding passage) of the sheet P is switched depending on whether or not the sheet P is subjected to the double-side printing. In the case of one-side printing, the sheet P is guided toward a discharging roller pair 171 by a first switching flap 173 and is discharged to an outside of the printer 100 by the discharging roller pair 171 as a discharging portion. In this embodiment, a portion from the electrophotographic mechanism 100A as an image forming portion to the discharging roller pair 171 is constituted as a third feeding passage along which the sheet on which the image is formed is fed.

In the double-side printing, the sheet P on which the image is formed on the first surface is guided to a reverse entrance roller pair 172 by the first switching flap 173 and is fed toward the reversing mechanism 200 through the reverse entrance roller pair 172. The reversing mechanism 200 carries out the switch-back feeding and feeds the sheet P to the double-side feeding mechanism 220 while temporarily retracting the sheet P by using the reverse retracting portion 300. A portion from the first switching flap 173 to a reversing roller pair 230 of the reversing mechanism 200 specifically described later is constituted as a first feeding passage (including an upstream feeding path 201) which branches from the third feeding passage and along which the sheet on which the image is formed by the electrophotographic mechanism 100A is fed.

The double-side feeding mechanism 220 merges with the feeding and conveying mechanism 110 on a side upstream of the secondary transfer portion 140 and feeds the sheet P, in a state in which the first surface and the second surface thereof are changed to each other by the reversing mechanism 200, to the feeding and conveying mechanism 110 again. The sheet P switched back by the reversing mechanism 200 is fed again toward the main feeding path 190 in the reversing mechanism 200. Then, the sheet P passes through the secondary transfer portion 140 and the fixing process mechanism 160 and thus the image is formed on the second surface, and thereafter, the sheet P is guided to the discharging roller pair 171 at this time and is discharged to the outside of the printer 100 by the discharging roller pair 171. Incidentally, a portion from the reversing roller pair 230 to the feeding and conveying mechanism 110 constitutes a second feeding passage (including a double-side feeding passage 202) along which the reversed sheet is fed and conveyed to the electrophotographic mechanism 100A.

Incidentally, as the sheet P used as the recording material, it is possible to use various sheets such as general-purpose plain paper, recycled paper, coated paper (paper subjected to surface treatment such as resin (material) coating), thin paper and thick paper.

Further, in this embodiment, a long (elongated) sheet (for example, a sheet longer than 420 mm which is a long side of an A3-size sheet) longer than a general-purpose regular size in terms of a length with respect to the sheet feeding direction can be used as the recording material. Incidentally, the long sheet is not necessarily limited to be accommodated in the accommodating portion 110*a* shown in FIG. 1, but for example, the long sheet is set on a manual feeding tray projecting outward on a side of the casing 101 and then may also be supplied one by one to the feeding and conveying mechanism 110 by a feeding roller.

Further, the printer 100 is provided with an operating portion 180 which is a user interface. The operating portion 180 includes a display device such as a liquid crystal panel for displaying information to the user and an input device such as physical keys or a touch panel functional portion for the liquid crystal panel, through which the user is capable of inputting an instruction or data to the printer 100. The user operates the operating portion 180 and thus is capable of changing, for example, setting as to whether or not the sheet used in a present print job is the long sheet. The printer controller 103*b* as a controller executes the print job by controlling the engine controller 103*a* on the basis of information received from the operating portion 180.

The above-described tandem and intermediary transfer type electrophotographic mechanism 100A (the optical developing process mechanisms 120, 121, 122 and 123, the intermediary transfer mechanism 152, the secondary transfer portion 140, and the fixing process mechanism 160) is an example of the image forming portion for forming the image on the sheet. When a technique described below is applied, for example, a direct transfer type electrophotographic mechanism in which the toner image formed on the photosensitive member is transferred onto the sheet without via the intermediary transfer member may also be used as the image forming portion. Further, the image forming portion is not limited to the electrophotographic mechanisms, and a printing unit of an ink jet type and an offset printing mechanism may also be used as the image forming portion.

(Reversing Mechanism)

Figure 2:
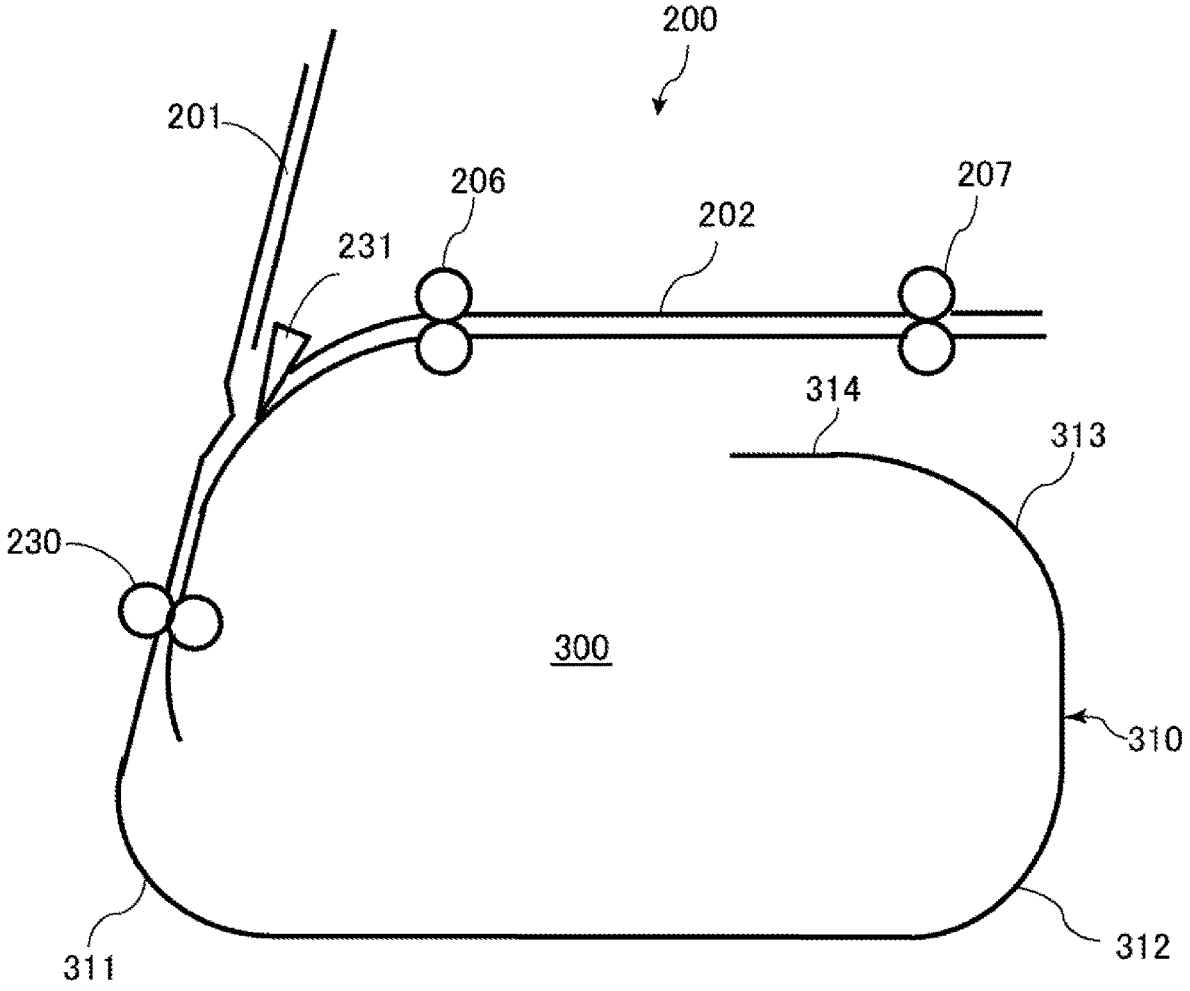
FIG. 2 is a schematic view of a reversing mechanism in the embodiment.

Next, the reversing mechanism 200 will be described. FIG. 2 is a schematic view when a periphery of the mechanism 200 is seen from a front side of the apparatus main assembly. Incidentally, in FIG. 2, for convenience of description, a droop preventing guide described later is omitted.

The reversing mechanism 200 includes the upstream feeding path 201, a double-side feeding path 202, a reversing roller pair 230, a double-side switching flap 231, the reverse retracting portion 300 and double-side feeding roller pairs 206 and 207. The upstream feeding path 201 is a part of the above-described first feeding passage through which the sheet guided to the reverse entrance roller pair 172 by the first switching flap 173 (FIG. 1) passes. The double-side feeding path 202 is a part of the above-described second feeding passage through which the sheet reversed by the reversing roller pair 230 passes and communicates with a merged portion with the main feeding path 190 through the double-side feeding mechanism 220.

The reversing roller pair 230 as a reversing roller portion is provided downstream (below with respect to the vertical direction) of a place where the upstream feeding path 201 and the double-side feeding path 202 merge with each other with respect to the feeding direction in the upstream feeding path 201. The reversing roller pair 230 is drive-connected to a motor capable of normal rotation and reverse rotation, for example, so that the sheet feeding direction is capable of being switched. The double-side switching flap 231 is provided at the place where the upstream feeding path 201 and the double-side feeding path 202 merge with each other and restricts that the sheet reversed by the reversing roller pair 230 enters the upstream feeding path 201.

The double-side feeding path 202 is provided with the double-side feeding roller pairs 206 and 207. The double-side feeding roller pairs 206 and 207 which are the feeding portion in this embodiment feed the sheet, which is reversed by the reversing roller pair 230 and which is sent to the double-side feeding path 202, toward the double-side feeding mechanism 220 through the double-side feeding path 202.

The reverse retracting portion 300 as a retracting portion is provided downstream of the reversing roller pair 230 with respect to the feeding direction in the upstream feeding path 201. The reverse retracting portion 300 forms a retracting region for temporarily retracting a part of the sheet when the reversing roller pair 230 switches back the sheet.

In this embodiment, as shown in FIG. 1, each of the main feeding path 190 and the double-side feeding path 202 extends in the substantially horizontal direction. Also in a range shown in FIG. 2, the double-side feeding path 202 extends from one side (left-hand side in the figure) toward the other side (right-hand side in the figure) in the horizontal direction. With respect to the vertical direction, the double-side feeding path 202 is provided below the main feeding path 190, and the reverse retracting portion 300 is provided below the double-side feeding path 202. In this embodiment, the fixing process mechanism 160 and the discharging mechanism 170 which are positioned above the reverse retracting portion 300 are in an arrangement relationship with the reverse retracting portion 300 such that each of the mechanisms 160 and 170 at least partially overlaps with the reverse retracting portion 300. Further, the reverse retracting portion 300 and the accommodating portion 110*a* are arranged in the horizontal direction and occupying ranges thereof with respect to the vertical direction overlap with each other. Such an arrangement is effective in suppressing upsizing of the printer 100 by disposing the reverse retracting portion 300.

Figure 3:
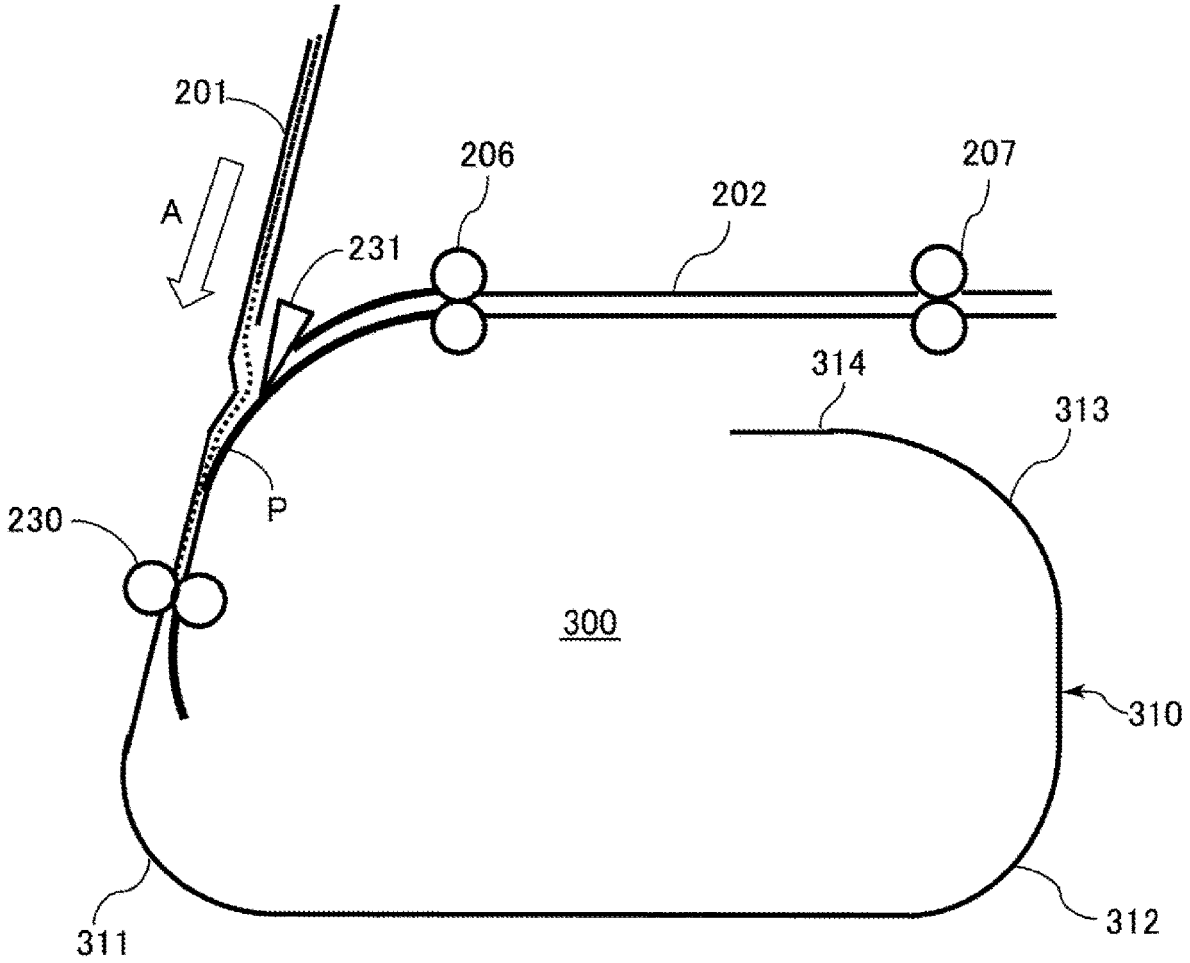
FIG. 3 is a schematic view showing a state of a sheet before reverse in a reversing operation of the sheet by the reversing mechanism in the embodiment.
Figure 4:
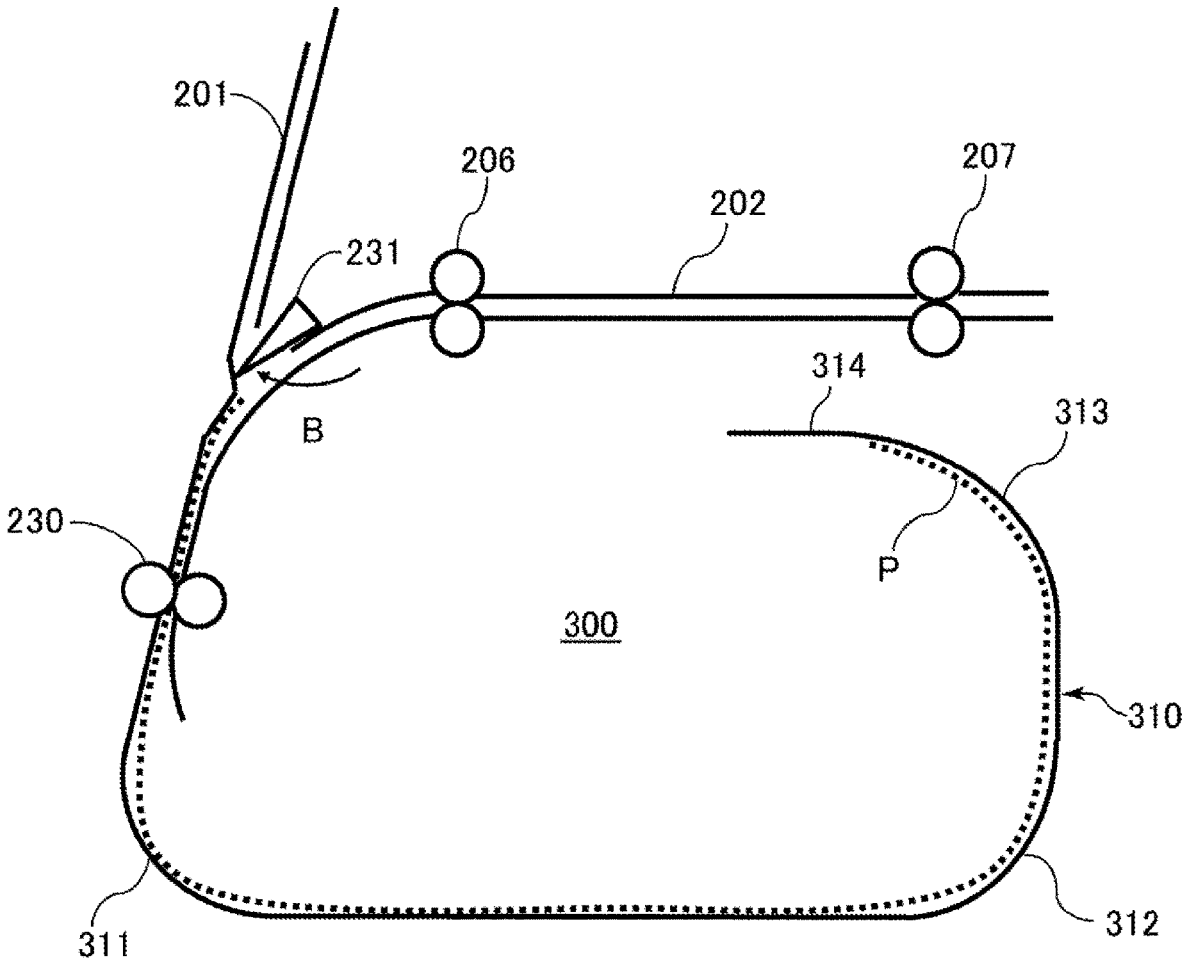
FIG. 4 is a schematic view showing a state of the sheet during the reverse in the reversing operation of the sheet by the reversing mechanism in the embodiment.
Figure 5:
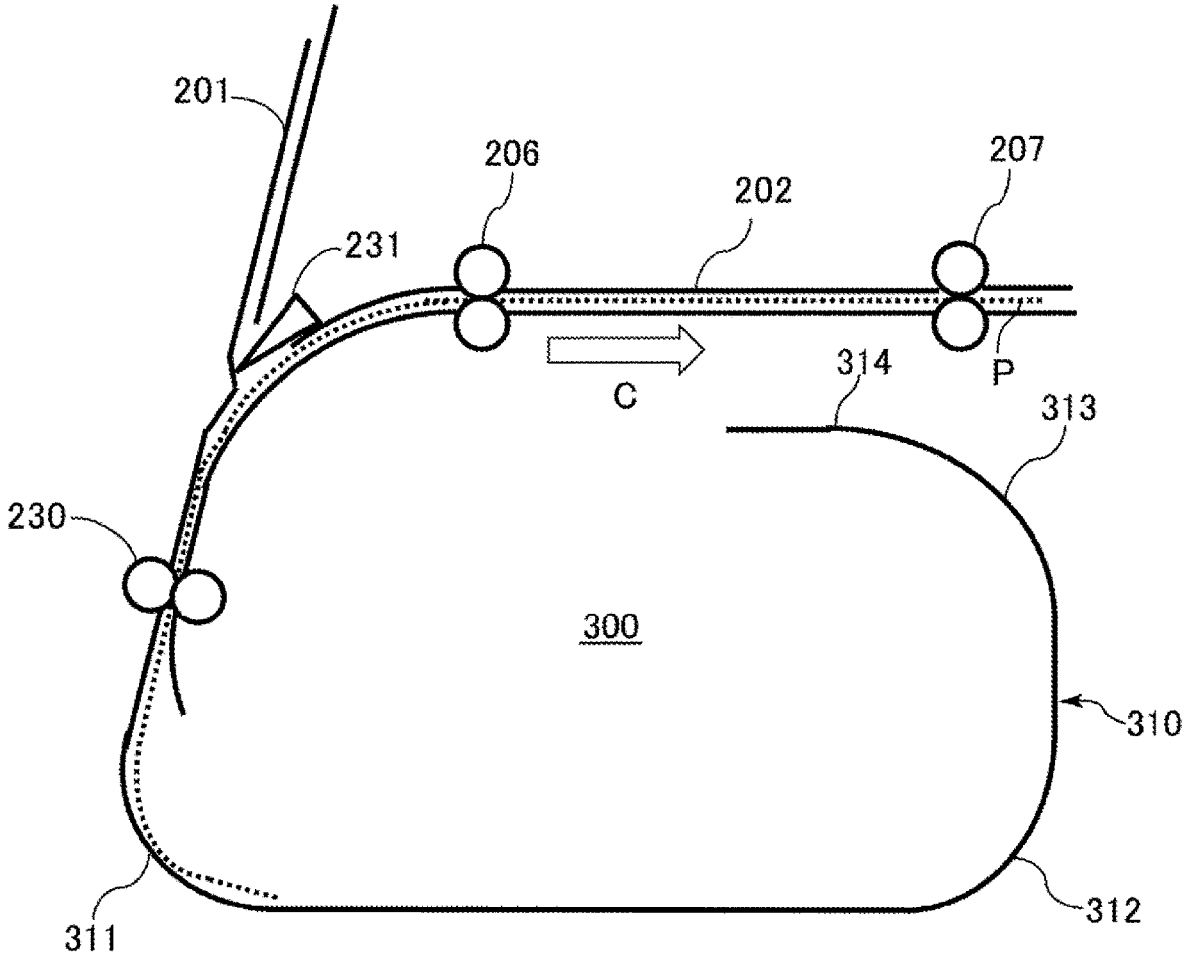
FIG. 5 is a schematic view showing a state of the sheet after the reverse in the reversing operation of the sheet by the reversing mechanism in the embodiment.

A basis operation of the sheet P in the reversing mechanism 200 will be described. FIGS. 3, 4 and 5 are schematic views showing the operation of the sheet P in the reversing mechanism 200, and show states of the sheet before the reverse (reversing operation), during the reverse and after the reverse, respectively.

The sheet P (broken line) fed from the reverse entrance roller pair 172 to the reversing mechanism 200 is fed along the upstream feeding path 201 and then is delivered to the reversing roller pair 230 (FIG. 3). The reversing roller pair 230 continues the feeding of the sheet P in a forward feeding direction A when receives the sheet P from the reverse entrance roller pair 172. At this time, the sheet P fed from the reverse roller pair 230 in the forward feeding direction A is accommodated in the reverse retracting portion 300 and thus is in a shaft state.

When a trailing end of the sheet P with respect to the forward feeding direction A passes through the double-side switching flap 231, rotation of the reversing roller pair 230 stops temporarily. Thereafter, the double-side switching flap 231 is rotated in an arrow B direction, and a direction of thereof is changed so as to guide the sheet P to the double-side feeding path 202 by restricting that the sheet P enters the upstream feeding path 201 (FIG. 4). After the direction of the double-side switching flap 231 is changed, the reversing roller pair 230 changes the sheet feeding direction to a reverse feeding direction C and feeds the sheet P. By this, the sheet P is fed to the double-side feeding path 202 and is conveyed by the double-side feeding roller pairs 206 and 207.

In the above, the case where the sheet reversed by the reversing mechanism 200 is fed along the double-side feeding path 202 was described, but the reversing mechanism 200 is also used in the case where face-down discharge of the sheet is carried out. The face-down double-side refers to an operation such that the sheet is discharged with the image-formed surface down in the case of the one-side printing. In the case of this embodiment, as shown in FIG. 1, a second switching flap 174 is provided on a side upstream of the reverse entrance roller pair 172, and in the case where the face-down discharge is carried out, the sheet reversed by the reversing mechanism 200 is guided to the discharging roller pair 171 by the second switching flap 174.

(Reverse Retracting Portion)

Figure 6:
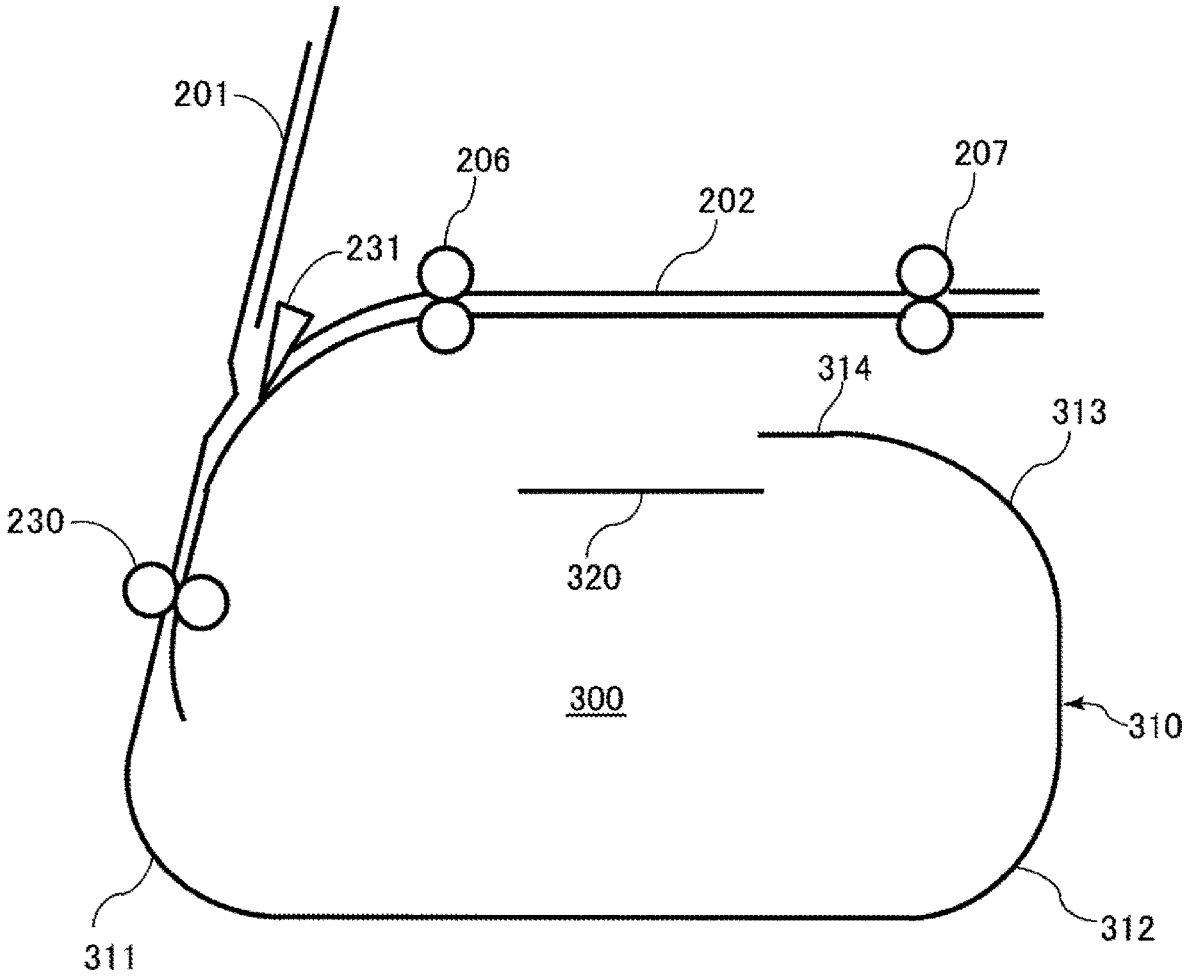
FIG. 6 is a schematic view showing a structure of a reverse retracting portion in a first embodiment.

Next, the reverse retracting portion 300 in this embodiment will be described. FIG. 6 is a schematic view when the reverse retracting portion 300 is seen from a front side of the apparatus main assembly.

The reverse retracting portion 300 is constituted by a guiding member 310 provided so as to surround a retracting region in which the sheet fed from the reversing roller pair 230 is retracted. The guiding member 310 forms the retraction feeding passage along which the leading end of the sheet follow an inner surface of the sheet when the sheet is fed so as to be retracted in the retracting region, i.e., the guiding member 310 is disposed only on one side of the retraction feeding passage. By this, the sheet slides only on one side of the retraction feeding passage, so that a feeding resistance becomes small compared with, for example, the case where guiding members are disposed on both sides of the retraction feeding passage.

The guiding member 310 includes three curved portions consisting of a first curved portion 311, a second curved portion 312 and a third curved portion 313 in the order close to the reversing roller pair 230 with respect to the forward feeding direction A of the reversing roller pair 230, and includes an extended portion 314 connected to the third curved portion 313. Incidentally, in FIG. 6, the guiding member 310 which is integrally formed is shown, but the guiding member 310 may also be constituted by being divided into a plurality of portions.

A leading end of the sheet P fed from the reversing roller pair 230 to the reverse retracting portion 300 is guided while contacting these first curved portion 311, second curved portion 312 and third curved portion 313. Specifically, the leading end of the sheet P sent from the reversing roller pair 230 downward is guided by the first curved portion 311 in the horizontal direction from an upstream side toward a downstream side with respect to the sheet feeding direction (one direction crossing the vertical direction) in the double-side feeding path 202. Then, the leading end of the sheet P is guided by the second curved portion 312 toward an upper side with respect to the vertical direction. Further, the leading end of the sheet P is then guided by the third curved portion 313 and the extended portion 314 in a direction (the other direction crossing the vertical direction) opposite to the sheet feeding direction in the double-side feeding path 202 with respect to the horizontal direction. Accordingly, when a relatively long sheet such as the long sheet (elongated sheet) is subjected to the switch-back by the reversing roller pair 230, the sheet is retracted inside the reverse retracting portion 300 in a state in which the sheet is curved along these curved portions.

(Droop of Elongated Sheet)

Next, forces acting when a droop of the leading end of the sheet in the reversing roller portion 300 occurs will be described using parts (a) and (b) of FIG. 7. In parts (a) and (b) of FIG. 7, an air resistance received by the leading end of the sheet P is represented by Fv, a force due to gravitation generated by the sheet P itself is represented by Fg, and a force for maintaining a shape of the sheet P by rigidity of the sheet P is represented by F. The droop of the leading end of the sheet P occurs when the following formula (1) is satisfied.

$$Fv+Fg>F \quad (1)$$

The droop is liable to occur in the case where a movement direction of the leading end of the sheet P passed through the second curved portion 312 is opposite to the forward feeding direction A of the reversing roller pair 230 and in the case where the leading end of the sheet P is in a position remote from the reversing roller pair 230 with respect to the forward feeding direction A. A shape of a portion of the sheet positioned close to a nip of the reversing roller pair 230 is regulated by the reversing roller pair 230. However, the shape of a portion of the sheet being in a position remote from the reversing roller pair 230 cannot be regulated by the reversing roller pair 230.

Particularly, the leading end of the sheet P is fed upward by the second curved portion 312 with respect to the substantially vertical direction, while the reversing roller pair 230 feeds downward the sheet P with respect to the substantially vertical direction, and therefore, the shape of the sheet P in the neighborhood of the leading end of the sheet P is not regulated by the reversing roller pair 230. For that reason, the sheet shape is maintained by rigidity of the sheet itself. In the case where the rigidity of the sheet P is low, the force F for maintaining the sheet shape by the rigidity is small, and therefore, the neighborhood of the leading end of the sheet P is liable to be influenced by the air resistance Fv and the gravity Fg (self-weight) of the sheet P itself. As shown in part (a) of FIG. 7, when the position of the leading end of the sheet P is a position in the neighborhood of the third curved portion 313, the gravity F by the self-weight of the sheet P is exerted substantially vertically, and therefore, the droop of the leading end of the sheet P does not readily occur.

On the other hand, the leading end of the sheet P further advances, and as the leading end of the sheet P exceeds the third curved portion 313, the leading end of the sheet P is liable to droop. As shown in part (b) of FIG. 7, when the leading end of the sheet P passes through the third curved portion 313, the position of the gravity of the sheet P itself exerted on the leading end of the sheet P is remoter from a position of the sheet P curved by the third curved portion 313. For that reason, the force generating the droop is a force of moment of (gravity Fg)×(distance a) and thus is liable to generate the droop of the sheet P.

Further, as shown in FIG. 8, the leading end of the sheet P droops, and when a switch-back operation by the reversing roller pair 230 is performed in a state in which the leading end portion of the sheet P is rounded, a force is exerted on the sheet P in a direction in which rounding of the sheet P is eliminated. At that time, depending on a feeding speed and a kind of paper (sheet), there is also a liability that the sheet P is damaged.

(Drooping Preventing Member)

In order to solve the above problem, in this embodiment, by providing a preventing member for preventing the droop of the leading end of the sheet P turned up and downward by the guiding member 310, rounding of the sheet P is prevented. In the following, a first embodiment and a second embodiment in which the preventing member is employed will be described as examples.

First Embodiment

First, a first embodiment will be described using FIGS. 6, 9 and 10. As shown in FIG. 6, a reversing roller portion 300 in the first embodiment is provided with, as the above-described droop preventing member, a droop preventing guide formed in a plate shape. The droop preventing guide 320 is disposed below a position of the third curved portion 313 of the guiding member 310 on a side toward the reversing roller pair 230 (toward the other direction) with respect to the horizontal direction. Specifically, a free end of the extended portion 314 and an end portion of the droop preventing guide 320 are offset and disposed so as to be in the substantially same position with respect to the vertical direction. That is, the droop preventing guide 320 is disposed on a side downstream of the third curved portion 313 and the extended portion 314 with respect to the forward feeding direction A of the reversing roller pair 230. Thus, the guiding member 310 and the droop preventing guide 320 are not disposed on both sides with respect to the retraction feeding passage as a passage along which the sheet is fed in the reversing roller portion 300, but are disposed on each of the sides. By this, both surfaces of the sheet P do not slide, so that an increase in slide resistance is prevented.

As shown in FIG. 9, in the reversing roller portion 300, when the sheet P which is the elongated sheet is fed in the forward feeding direction A until immediately before being subjected to the switch-back by the reversing roller pair 230, the leading end of the sheet P slightly droops. However, the droop preventing guide 320 is disposed, and therefore, the leading end of the sheet P is contacted to and supported by the upper surface of the droop preventing guide 320, and thus further droop of the sheet leading end is prevented.

Further, as shown in FIG. 10, when the sheet P is subjected to the switch-back by the reversing roller pair 230, a force by which a portion of the sheet P positioned inside the first curved portion 311, the second curved portion 312 and the third curved portion 313 is urged inward as shown by arrows in FIG. 10 generates. However, the droop preventing guide 320 is not disposed inside the first to third curved portions 311, 312 and 313 so as to oppose these curved portions, and therefore, even when the sheet P moves toward the inside of the respective curved portions, the feeding resistance is not generated, so that an increase in load of the reversing roller pair 230 is prevented.

Incidentally, in the first embodiment, the droop preventing guide 320 formed in the plate shape was described, but the present invention is not limited thereto, and for example, the droop preventing guide may also be a roller (follower roller), a wire or the like, and may also be any member if the member is capable of preventing the droop of the leading end of the sheet.

As described above, in the printer 100 of the first embodiment the guiding member 310 of the reversing roller portion 300 is disposed on one side of the retraction feeding passage along which the sheet is fed by the reversing roller pair 230, so that an increase in feeding resistance is prevented. Further, by providing the droop preventing guide 320, for example, in the case where the elongated sheet is fed to the reversing roller portion 300, it is possible to prevent the sheet leading end from rounding due to the droop of the sheet leading end.

By this, when the rounded sheet is switched back and fed, for example, it is possible to prevent damage on the sheet such that a trace of folding or the like generates.

Second Embodiment

A second embodiment will be described using FIG. 11. In the first embodiment, the constitution in which the droop preventing guide 320 was disposed on the side downstream of the third curved portion 313 with respect to the forward feeding direction A was described. However, in this embodiment (second embodiment), as the droop guiding member, a droop preventing guide 330 and a roller 331 are provided on a side downstream of the second curved portion 312 with respect to the forward feeding direction A. As described above, when the droop preventing guide is disposed on the side upstream of the third curved portion 313, by the guiding member 310 and the droop preventing guide, the guiding members are disposed on both sides of the retraction feeding passage, so that there is a liability that the feeding resistance of the sheet generates. However, for example, in the case where there is a need to meet a sheet, such as thin paper, with an extremely small rigidity, there is possibility that the droop occurs before the sheet leading end reaches the downstream side of the third curved portion 313 with respect to the forward feeding direction A.

Accordingly, in this embodiment, in order to meet the sheet with the small rigidity, as shown in FIG. 11, the plate-like droop preventing guide 330 is disposed on a side downstream of the second curved portion 312 with respect to the forward feeding direction A, from a position opposing the third curved portion 313. Further, in order to prevent an increase in sheet feeding resistance, a rotatable follower roller 331 is disposed at an upstream end portion of the droop preventing guide 330 with respect to the forward feeding direction.

By this, although when the sheet which is, for example, thin paper or the like with the low rigidity and which is the elongated sheet is fed to the reversing roller portion 300, there is a liability that the droop of the sheet leading end occurs before the sheet leading end reaches the extended portion 314, the droop of the sheet can be prevented by the droop preventing guide 330. Further, when the sheet is subjected to the switch-back by the reversing roller pair 230, the roller 331 which is a rotatable member as a slidable member for reducing the slide resistance is rotated by the movement of the sheet. By this, the slide resistance between the sheet and the droop preventing guide 330 is reduced, so that it is possible to prevent an increase in feeding resistance of the sheet during the switch-back.

Incidentally, in the second embodiment, the droop preventing guide 330 formed in the plate shape was described, but the present invention is not limited thereto, and for example, the droop preventing guide may also be a roller (follower roller), a wire or the like, and may also be any member if the member is capable of preventing the droop of the leading end of the sheet. Particularly, in the case where the droop preventing guide 330 is constituted by the roller, the roller 331 provided on the upstream side with respect to the forward feeding direction is disposed on the end portion, and a plurality of rollers are arranged toward the downstream side with respect to the forward feeding direction.

As described above, also in the printer 100 of the second embodiment the guiding member 310 of the reversing roller portion 300 is disposed on one side of the retraction feeding passage along which the sheet is fed by the reversing roller pair 230, so that an increase in feeding resistance is prevented. Further, by providing the droop preventing guide 330, for example, in the case where the elongated sheet is fed to the reversing roller portion 300, it is possible to prevent the sheet leading end from rounding due to the droop of the sheet leading end. By this, when the rounded sheet is switched back and fed, for example, it is possible to prevent damage on the sheet such that a trace of folding or the like generates. Further, in the second embodiment, it is possible to meet the sheet such as the thin paper with the small rigidity. Further, by disposing the roller 331, it is also possible prevent the increase in feeding resistance of the sheet.

(Stack of Sheets when Jam Occurs)

Next, use of the reversing roller portion 300 when the jam occurs will be described using FIG. 12. As described above, the reversing roller portion 300 was a portion where a space for temporarily retracting the sheet when the sheet is reversed by the reversing roller pair 230 was ensured. However, in the printer 100, in the case where the first feeding passage is usable and another feeding passage causes a jam (paper jam) and thus is unusable, an inside space of the reversing roller portion 300 can be used as a space in which the sheet stagnating inside the printer 100 is discharged.

Specifically, in the printer, in the case where an unshown door is provided on a front side of the reversing roller portion 300 and the sheet is present in the reversing roller portion 300, the sheet can be discharged by opening the door. As shown in FIG. 1, for example, in the case where the jam occurs in the third feeding passage from the first switching flap 173 to the discharging roller pair 171, the sheet positioned inside the printer 100 cannot be discharged to the outside of the printer 100 through the discharging roller pair 171. Further, for example, in the case where the jam occurs in the second feeding passage from the reversing roller pair 230 to the feeding and conveying mechanism 110, the sheet cannot be fed to the double-side feeding passage 202 by being reversed by the reversing roller pair 230.

In the case where such a jam occurs, the printer controller 103*b* rotates the reversing roller pair 230 only in the forward feeding direction, so that the sheet stagnating inside the printer 100, particularly stagnating at a portion from the feeding and conveying mechanism 110 to the electrophotographic mechanism 100A is discharged into the reversing roller portion 300. By this, as shown in FIG. 12, sheets P1 successively discharged from a lower portion between the first curved portion 311 and the second curved portion 312 of the guiding member 310 in the space of the reversing roller portion 300 are stacked. These sheets P1 are assumed that a length thereof falls within a length between the first curved portion 311 and the second curved portion 312.

As described above, the guiding member 310 forms the retraction feeding passage only by one side thereof, i.e., the guide is not provided on all the both sides, and therefore, the reversing roller portion 300 can be used as a sheet discharging space when the jam occurs, as described above. Further, the droop preventing guide 320 in the first embodiment is disposed on the side downstream of the extended portion 314 with respect to the forward feeding direction, and the droop preventing guide 330 in the second embodiment is disposed at the position opposing the third curved portion 313 and the extended portion 314. That is, the droop preventing guides 320 and 330 are disposed on an upper side which is at least an upper half of the space of the reversing roller portion 300, so that a space in which the sheets discharged therein are stacked can be largely ensured. Thus, the space can be largely ensured, so that there is no need to perform operations of opening and closing of the guiding member 310 and the droop preventing guides 320 and 330 and of removal of the droop preventing guides 320 and 330, and the like operation, and thus an operation during jam clearance can be simplified. (Possibility of other embodiments)

In the above-described embodiments, the constitution in which the guiding members 310 for the reversing roller portion 300 where curved at three portions consisting of the first curved portion 311, the second curved portion 312 and the third curved portion 313 was described. However, the present invention is not limited thereto, and for example, in the case where the sheet is fed from the reversing roller pair in the horizontal direction, the droop of the sheet can be prevented by providing two curved portions corresponding to the second curved portion 312 and the third curved portion 313, and the present invention is applicable thereto.

Further, in the embodiments of the present invention, the reversing roller portion 300 disposed below the printer 100 while being juxtaposed with the accommodating portion 110*a* was described. However, the present invention is not limited thereto, and the reversing roller portion 300 may also be disposed at any place if the reversing roller portion 300 is positioned inside the printer 100.

In the above-described embodiments, the guiding members 310 integrally formed with the first to third curved portions 311, 312 and 313 were described. However, the present invention is not limited thereto, and for example, each of the guiding members may also be divided in any manner such that the guiding member is divided into a portion where the first curved portion 311 is formed and a portion where the second curved portion 312 and the third curved portion 313 are formed. Thus, in the case where the guiding member 310 is divided, it is preferably that an end portion of an upstream member is provided inside an end portion of a downstream member with respect to the forward feeding direction, i.e., the guiding member is configured so that the leading end of the sheet is not caught by the guiding member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-142194 filed on Aug. 1, 2019, which is hereby incorporated by reference herein in its entirety.

What is claimed is:

1. An image forming apparatus comprising:

an image former configured to form an image on a sheet to be fed;

a reversing roller configured to reverse the sheet, on which a first surface thereof the image is formed by said image former, by feeding the sheet by rotation thereof in a first direction and then by feeding the sheet by rotation thereof in a second direction opposite to the first direction;

a first feeding guide pair configured to guide the sheet, on which the first surface thereof the image is formed by said image former, toward said reversing roller;

a second feeding guide pair configured to guide the sheet, reversed by said reversing roller, toward said image former to form an image on a second surface of the sheet opposite from the first surface;

a guide configured to (a) guide upward a leading end of the sheet fed from said reversing roller rotating in the first direction and (b) guide the sheet, guided upward, in a direction crossing a vertical direction, said guide having an inner surface curved to guide the first surface of the sheet; and a supporter configured to support the sheet so as to prevent a droop of the leading end of the sheet by contact with the sheet guided in the direction crossing the vertical direction by said guide, wherein the supporter is provided between said second feeding guide pair and said reversing roller in the vertical direction.

2. An image forming apparatus according to claim 1, wherein said guide includes:

a first curved portion configured to guide the leading end of the sheet, fed from said reversing roller rotating in the first direction, in one direction crossing the vertical direction;

a second curved portion configured to guide upward the leading end of the sheet guided in the one direction by said first curved portion; and a third curved portion configured to guide the leading end of the sheet, guided upward by said second curved portion, in the other direction crossing the vertical direction.

3. An image forming apparatus according to claim 2, wherein said supporter is provided below said third curved portion with respect to the other direction.

4. An image forming apparatus according to claim 3, wherein said guide further includes an extended portion which is connected to said third curved portion and which extends in the other direction.

5. An image forming apparatus according to claim 2, wherein said supporter is provided above said second curved portion so as to oppose an inner surface of said guide.

6. An image forming apparatus according to claim 1, wherein said supporter is a plate member provided opposed to said guide.

7. An image forming apparatus according to claim 1, wherein said supporter includes a slidable portion having a sliding resistance smaller than said guide.

8. An image forming apparatus according to claim 7, wherein said slidable portion is a rotatable member suppressed rotatably.

9. An image forming apparatus according to claim 1, further comprising:

a discharger configured to discharge the sheet, on which the image is formed by said image former, to an outside of said image forming apparatus;

a third feeding guide pair configured to feed the sheet, on which the image is formed by said image former, to said discharger; and a controller, wherein said controller causes said reversing roller to discharge the sheet, fed from said image former, from said first feeding guide pair when said first feeding guide pair is usable but other feeding passages are unusable.

10. An image forming apparatus comprising:

an image former configured to form an image on a sheet to be fed;

a reversing roller configured to reverse the sheet, on which a first surface thereof the image is formed by said image former, by feeding the sheet by rotation thereof in a first direction and then by feeding the sheet by rotation thereof in a second direction opposite to the first direction;

a first feeding guide pair configured to guide the sheet, on which the first surface thereof the image is formed by said image former, toward said reversing roller;

a second feeding guide pair configured to guide the sheet, reversed by said reversing roller, toward said image former to form an image on a second surface of the sheet opposite from the first surface;

a guide configured to (a) guide upward a leading end of the sheet fed from said reversing roller rotating in the first direction and (b) then guide the sheet, guided upward, in a direction crossing a vertical direction, said guide having an inner surface curved to guide one side of the sheet; and a supporter configured to support the sheet guided at the leading end of the sheet in the direction crossing the vertical direction by said guide, wherein the supporter is provided between said second feeding guide pair and said reversing roller in the vertical direction.

11. An image forming apparatus according to claim 1, further comprising a second guide configured to guide the second surface of the sheet passing between said reversing roller and said supporter in the first direction, wherein said second guide is not provided at a position facing said guide.

12. An image forming apparatus according to claim 1, wherein said reversing roller is configured to convey the leading end of the sheet downward in the vertical direction.

13. An image forming apparatus comprising:

an image former configured to form an image on a sheet to be fed;

a reversing roller configured to reverse the sheet, on which a first surface thereof the image is formed by said image former, by feeding the sheet by rotation thereof in a first direction and then by feeding the sheet by rotation thereof in a second direction opposite to the first direction, a guide configured to guide the first surface and to guide upward a leading end of the sheet, fed from said reversing roller rotating in the first direction, wherein said guide has a point where the leading edge of the sheet having a predetermined length in the sheet conveyance direction guided by said guide has reached a top; and a supporter configured to support the sheet so as to prevent a droop of the leading end of the sheet by contact with the sheet guided by said guide, wherein said supporter is provided downstream, in a sheet feeding direction in which said reversing roller rotating in the first direction feeds the sheet, of the point of said first guide, and wherein said supporter is provided between said reversing roller and the point of said guide in a horizontal direction.

14. An image forming apparatus according to claim 13, wherein said reversing roller is configured to convey the leading end of the sheet downward in a vertical direction in a case in which said reversing roller rotates in the first direction.

15. An image forming apparatus according to claim 14, wherein said guide includes (1) a downward guide, (2) a horizontal guide, and (3) an upward guide, wherein the downward guide is configured to guide downward the leading end of the sheet, fed from said reversing roller rotating in the first direction, wherein the horizontal guide is configured to guide the leading end of the sheet, guided by the downward guide, in the horizontal direction, wherein the upward guide is configured to guide upward the leading end of the sheet, guided by the horizontal guide, wherein the image forming apparatus further comprises a second guide, the second guide being configured to guide a second surface opposite from the first surface of the sheet, and wherein said second guide is provided at a position facing said downward guide.

16. An image forming apparatus according to claim 13, further comprising:

a re-feeding guide configured to guide the sheet, reversed by said reversing roller, toward said image former to form an image on a second surface opposite from the first surface of the sheet wherein said first guide is provided downward of said re-feeding guide in the vertical direction, and wherein a downward edge of said first guide is provided upward of said supporter in the vertical direction.

17. An image forming apparatus according to claim 13, wherein the predetermined length in the sheet conveyance direction is larger than 420 mm.

18. An image forming apparatus according to claim 13, wherein the horizontal direction is a direction perpendicular to a rotational axis direction of said reversing roller.

* * * * *